US005520264A

United States Patent [19]

Korhonen

[11] Patent Number: 5,520,264

[45] Date of Patent: May 28, 1996

[54] PROCEDURE FOR THE FIXING OF GUIDE RAILS

[75] Inventor: Helge Korhonen, Oitti, Finland

[73] Assignee: Kone Oy, Helsinki, Finland

[21] Appl. No.: 301,496

[22] Filed: Sep. 7, 1994

[30] Foreign Application Priority Data

Sep. 10, 1993 [FI] Finland ..... 933995

[51] Int. Cl.[6] ..... B66B 7/02

[52] U.S. Cl. ..... 187/408; 52/30

[58] Field of Search ..... 187/408, 406, 187/404; 52/30

[56] References Cited

U.S. PATENT DOCUMENTS 1,702,783 2/1929 Kiesling ..... 187/408

2,463,215 3/1949 Strachan ..... 187/408

3,948,358 4/1976 Atkey ..... 187/95

*Primary Examiner*—Kenneth Noland

[57] ABSTRACT

The invention relates to a procedure for fixing the guide rails (3) of an elevator car (4) and/or counterweight, in which procedure the guide rails (3) of the elevator car and counterweight are fixed to the wall (12) of the elevator shaft or to an intermediate member laid across the elevator shaft. The car guide rails (4) and counterweight guide rails (3) are locked at a desired distance from the wall by fixing elements (11) used to fix the counterweight guide rails (3).

5 Claims, 1 Drawing Sheet

PROCEDURE FOR THE FIXING OF GUIDE RAILS

BACKGROUND OF THE INVENTION

The present invention relates to a procedure for adjusting and fixing the guide rails of an elevator car and/or counterweight to an elevator shaft.

In the case of a concrete shaft, the guide rails are most commonly fixed by means of rail clamps directly to C-profile rails provided in the shaft walls. In shafts shared by several elevators in a bank, when no partitions are provided, intermediate members are used to which the guide rails are fixed by means of rail clamps. The guide rails can be fixed to the shaft wall by means of sturdy threaded bars welded onto plates fixed to the wall. A structure like this is ill suited for custom processes as it requires several work phases.

Intermediate members are often used in an elevator shaft e.g. to divide the shaft into two or more sections, each section accommodating a separate elevator car running along guide rails fixed to the intermediate members. Intermediate members can also be used in connection with counterweights or to fit an elevator car in an oversized elevator shaft.

Previously known rail fixing methods have the drawbacks that the guide rails are difficult to adjust because of the rigid welded joints used and that the safety aspects relating to installation require a great accuracy on the part of the person performing the welding, who is generally an elevator installer, not a professional welder. In practice, in the fixing of guide rails, allowance has to be made for fairly large tolerances in the elevator shaft and the rail fixing elements in it, resulting in longer installation times. Further problems result from the difficulty of extending power cables to the various welding points in the elevator shaft.

SUMMARY OF THE INVENTION

The object of the present invention is to avoid the above-mentioned drawbacks and to achieve a procedure for fixing the guide rails and their supporting structures in an elevator shaft quickly and so as to obtain sufficient rigidity without welded joints.

The advantages provided by the present invention include the following:

- well suited for installation without scaffolding
- every screw joint can be tightened by using one and the same spanner
- all screws and nuts are the same size
- the distance between the counterweight guide rails as well as their position relative to the car guide rail are predesigned during manufacture
- allows the guide rails to be moved in the direction of the wall
- reduces installation costs
- parts can be moved relative to each other by means of a screwdriver and adjusting holes Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein: the aid of examples by referring to the attached drawings, in which.

DETAILED DESCRIPTION OF THE PREFERRED EMBODIMENTS

Figure 1:
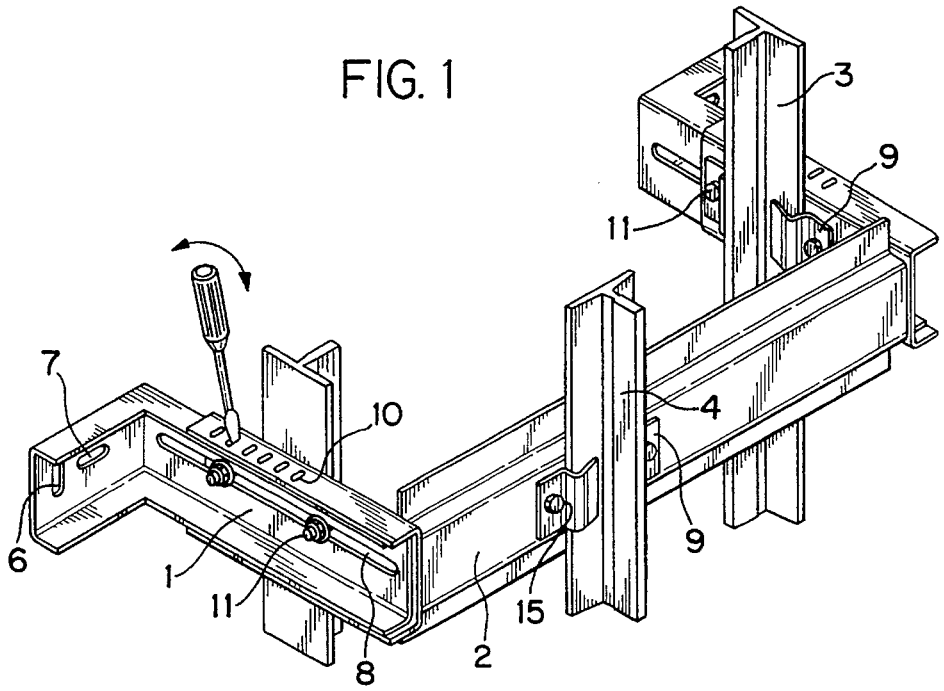
FIG. 1 illustrates the fixing of counterweight and car guide rails in lateral view.

FIG. 1 shows how the guide rails for the car and counterweight are fixed to a shaft wall or to an intermediate member. The fixing procedure comprises two U-shaped members 1 and 2 and U-shaped members 13 joined by welding to the ends of member 2. The wall mounting member 1 consists of a plate bent into a U-shaped member having the form of an L. It has bent edges to obtain a sufficient rigidity. The shorter part of the wall mounting member 1 is provided with two holes 6 and 7 permitting attachment to a shaft wall. The holes 6 and 7 have an elongated shape and are placed at right angles to each other. Hole 6 is for vertical adjustment and hole 7 for horizontal adjustment. These holes permit the L-shaped wall mounting member 1 to be fixed to a C-profile in the wall and allow fine adjustment of its position. The fine adjustment holes 10 are placed in the longer part of the wall mounting member and in its bent edge which lies above. They are suitably placed with respect to each other. The wall mounting member 1 of the counterweight is provided with holes during manufacture, depending on the position of the counterweight guide rails 3 relative to each other. The longer part of the wall mounting member 1 is provided with an elongated hole 8 to permit horizontal adjustment of the car guide rail 4. The elongated hole 8 is placed centrally in the wall mounting member 1 and lies at an equal distance from its longer sides. It also lies at an equal distance from the shorter sides of the part. The elongated holes 6,7 and 8 in the L-shaped wall mounting members 1 render these members adjustable. The fixing parts 13 are provided with fixing holes 14 for the fixing of the counterweight guide rails 3. The counterweight guide rails 3 are fixed by means of the fixing parts 13, rail clips 9 and screws 11 and nuts to the wall mounting members 1, using the fixing holes 14. The car guide rails 4 are locked at a suitable distance from the wall by means of fixing elements 11, which are also used to fix the counterweight guide rails 3. The hole 8 in the wall mounting member 1 is advantageously located, enabling the car guide rail fixing member 2 to be moved horizontally in the direction of the hole 8. The car guide rail 4 is attached by means of rail clips 9 to the guide rail fixing member 2, at or near its middle portion. The rail clip is so designed that it prevents the screw from turning when the nut is being turned. The car guide rail fixing member 2 is a U-shaped beam. The holes 14 have a round shape and they are used to secure the rail clips 9 and the screws and nuts used as fixing elements. The counterweight fixing screws 11 now go through the holes 14 in the fixing part 13 and through the horizontal elongated hole 8 in the L-shaped wall mounting member 1 and parts 1 and 13 can thus be moved with respect to each other by using the adjusting holes in these parts 1 and 13. After all the guide rails have been brought to their correct positions, all the fixing screws are tightened. The bent edges of parts 1 and 13 are provided with fine adjustment holes 10, whose number and position can be selected according to need.

Figure 2:
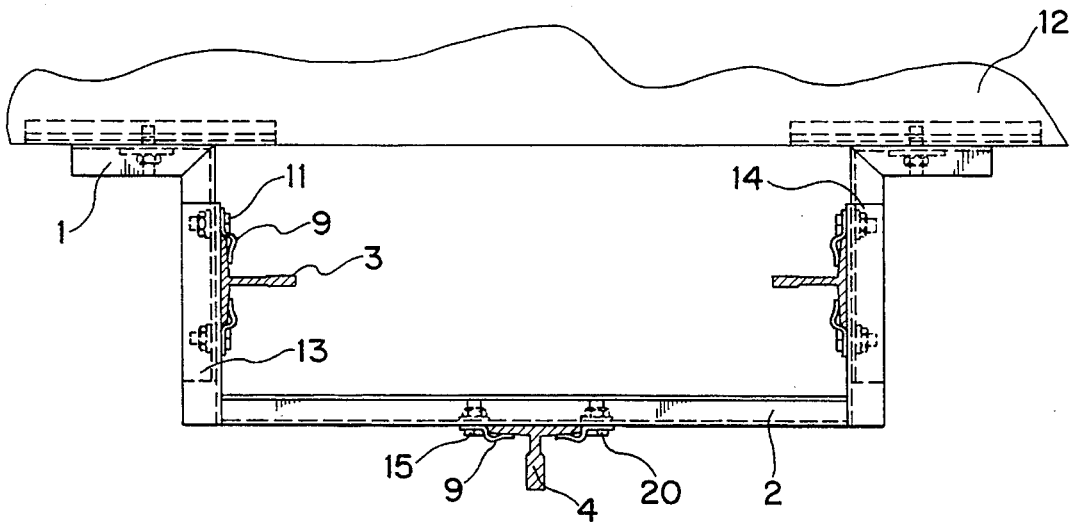
FIG. 2 illustrates the same fixing method in top view.

FIG. 2 illustrates the same fixing method in top view. This FIG. 2 also shows the fixtures attaching the L-shaped wall mounting member 1 to a C-profile rail. The counterweight may also be placed behind the car, in which case the car guide rails 4 need not be fixed in the manner illustrated by FIGS. 1 or 2 but are instead fixed to the adjacent walls. The same fixing screws 11 are used to lock the car guide rails 4 at a suitable distance from the wall and to fix the counterweight guide rails 3. The screws 11 are passed via holes 14 and 8. Holes 14 are used to fix the counterweight guide rails 3 and the elongated holes 8 to lock the car guide rail 4 at the correct distance from the wall. The car guide rail 4 is adjusted by the aid of holes 8 in a direction perpendicular to the shaft wall 12 until the rail lies at the correct distance from the wall 12, whereupon the rails 4 are locked in place by tightening the screws 14. The car guide rail 4 is attached to fixing member 2 by means of holes 20 and screws 15. Holes 14 and 20 are made in the correct positions during manufacture, ensuring that the car guide rail 4 and the counterweight guide rails 3 are automatically placed correctly with respect to each other. It is also possible to place the car guide rails on a different side of the car than the counterweight guide rails, in which case the solution according to claim 1 only comprises two guide rails.

It is obvious to a person skilled in the art that different embodiments of the invention are not restricted to the examples described above, but that they may instead be varied within the scope of the following claims. The materials used in the fixing members 1 and 2 may vary according to need, and similarly the shape and structure of these members 1 and 2 may vary and they may be manufactured from different materials. The wall mounting members I can also be replaced with beams of different shapes. The positions of the holes for the screws can be suitably selected for each case separately and their number can be selected according to the situation. There may be several car guide rails.

I claim:

1. A method for fixing guide rails for an elevator car and/or counterweight, in which method a car guide rail and a counterweight guide rail are fixed to a wall of an elevator shaft or to an intermediate member laid transversely across the shaft, said method including the steps of:

installing a U-shaped mounting member in the shaft, the U-shaped mounting member including a pair of arms and a connecting member interconnecting the pair of arms;

fastening the car guide rail to the connecting member of the U-shaped mounting member using a first fastener; and fastening the counterweight guide rail to one of the arms of the U-shaped mounting member using a second fastener such that the second fastener also fixes the car guide rail and the counterweight guide rail at a desired distance from the shaft wall.

2. The method for fixing guide rails according to claim 1, and further including the steps of:

providing a pair of wall mounting members for attachment with the pair of arms of the U-shaped mounting member; and placing an elongated hole in each of the wall mounting members, said elongated holes enabling the car guide rail and counterweight guide rail to be adjusted in a direction perpendicular to the shaft wall.

3. The method for fixing guide rails according to claim 1, and further including the step of:

providing the pair of arms and the connecting member with round holes by means of which the car guide rail and counterweight guide rail are fixed and locked with respect to each other.

4. The method for fixing guide rails according to claim 2, and further including the step of:

providing each of the wall mounting members with first and second elongated apertures, with the second elongated apertures being elongated in a direction perpendicular to a direction of elongation of the first elongated apertures.

5. The method for fixing guide rails according to claim 4, and further including the step of:

adjusting the car guide rail to the correct height and distance with respect to the shaft wall by means of the elongated holes and the first and second elongated apertures.

* * * * *